US006141822A

United States Patent [19]

Riviera-Boklund et al.

[11] Patent Number: 6,141,822

[45] Date of Patent: Nov. 7, 2000

[54] VACUUM CLEANER FOR HOUSEHOLD REFUSE

[75] Inventors: Agneta Riviera-Boklund, Vandoeuvres; Antonio Jimenez, Meyrin, both of Switzerland

[73] Assignee: Certech SA, Société Anonyme, Vandoeuvres, Switzerland

[21] Appl. No.: 09/269,470

[22] PCT Filed: Sep. 24, 1997

[86] PCT No.: PCT/EP97/05257

§ 371 Date: Mar. 24, 1999

§ 102(e) Date: Mar. 24, 1999

[87] PCT Pub. No.: WO98/12957

PCT Pub. Date: Apr. 2, 1998

[30] Foreign Application Priority Data

Sep. 26, 1996 [CH] Switzerland ..... 2356196

[51] Int. Cl.[7] ..... A47L 5/36

[52] U.S. Cl. ..... 15/325; 15/327.2; 15/327.3; 15/327.4

[58] Field of Search ..... 15/327.2, 327.3, 15/327.4, 327.5, 325, 339

[56] References Cited

U.S. PATENT DOCUMENTS

| | | | |
|---|---|---|---|
| 2,392,205 | 1/1946 | Wales | 15/327.5 X |
| 2,920,337 | 1/1960 | Smith | 15/327.5 X |
| 4,993,105 | 2/1991 | Buchtel | 15/327.2 X |
| 5,392,492 | 2/1995 | Fassauer | 15/327.3 |
| 5,799,363 | 9/1998 | Inoue et al. | 15/327.3 |

*Primary Examiner*—Chris K. Moore
*Attorney, Agent, or Firm*—William H. Eilberg

[57] ABSTRACT

The invention concerns a vacuum cleaner including an internal structure with a motor (12*a*) driving an air sucking turbine (12) located in a downstream chamber (16) communicating with an upstream chamber (15) containing means (13, 26) for filtering the air sucked in through an air intake (24). The internal structure is enclosed in an inflatable peripheral structure (30) supplied with air through the air outlet (29) of the downstream chamber (16). The inflatable peripheral structure (30) is delimited by a flexible peripheral wall (32) whose envelope completely encloses the assembly of the vacuum cleaner internal structure. The invention is applicable to vacuum cleaners for household refuse, and provides at an inexpensive and efficient protection against collisions between the vacuum cleaner and surrounding objects.

12 Claims, 8 Drawing Sheets

VACUUM CLEANER FOR HOUSEHOLD REFUSE

TECHNICAL FIELD OF THE INVENTION

The present invention concerns a mobile vacuum cleaner for household refuse, having an internal structure including means for aspirating air laden with household refuse via an air inlet, means for filtering the aspirated air and retaining the household refuse that it contains, means for evacuating the filtered air via at least one air outlet, and a protective structure adapted to minimise or eliminate damages caused by impacts between the vacuum cleaner and other objects such as surrounding furniture.

Vacuum cleaners including a peripheral protective structure are already known per se, for example the device described in document DE 30 42 894 A. The vacuum cleaner described in the above document includes a casing mounted on wheels with a sealed elastic band around it provided with air evacuation openings. The aspirated air exiting the motor is propelled through an opening between the rigid casing of the vacuum cleaner and the elastic band to generate a layer of air under the elastic band, which constitutes a structure for damping lateral impacts between the vacuum cleaner and a piece of furniture. This structure is found not to damp heavy impacts satisfactorily, probably because of the necessarily thin layer of air between the casing and the elastic band. What is more, the elastic band must be fixed to the casing in a sealed manner, which implies a relatively complex and costly construction.

Document DE 22 13 716 A describes another mobile vacuum cleaner construction for household refuse in which the bottom face of the vacuum cleaner comprises a non-inflatable closed cell foam mattress constituting a soft surface resting on the floor to avoid scratching the floor in the presence of grains of sand.

Document U.S. Pat. No. 4,947,506 A describes a mobile vacuum cleaner for household refuse the casing of which is covered with non-inflatable covering members, on the top and on the periphery. The attached covering members are made of high-density foam capable of absorbing the energy of impacts between the vacuum cleaner and surrounding objects.

Document U.S. Pat. No. 4,533,370 A describes a mobile vacuum cleaner structure for household refuse the casing of which has a rigid peripheral tubular member around it through which the vacuum cleaner exhaust air flows to reduce air exhaust noise. The surface beyond the peripheral tubular member can be covered with a soft covering, for example PVC resin, to constitute simultaneously a shock absorber. The structure is not inflatable.

It is found that the prior art structures provide insufficient protection, and simultaneously increase the cost of manufacture in proportions that are unacceptable given the result obtained.

SUMMARY OF THE INVENTION

The problem addressed by the present invention is that of designing a new vacuum cleaner structure capable of simultaneously absorbing impacts between the vacuum cleaner and surrounding objects effectively, and reducing the overall cost of production of the vacuum cleaner.

Another advantage of the invention is being able to impart diverse outside shapes to the vacuum cleaner for a common internal structure.

It is equally feasible, in accordance with the invention, for the vacuum cleaner to have an external shape that can be modified at will, in a convenient and inexpensive fashion.

To achieve the above and other objects, a vacuum cleaner in accordance with the invention comprises an internal structure having means for aspirating air laden with household refuse via an air inlet, means for filtering the aspirated air and retaining the household refuse that it contains, means for evacuating the filtered air via at least one air outlet, and an inflatable peripheral structure supplied with air via said air outlet; the inflatable peripheral structure is delimited by one or more flexible outside peripheral walls the envelope of which entirely surrounds all of the internal structure of the vacuum cleaner comprising the air suction, filter and exhaust means.

In one preferred embodiment, a portion of the inflatable peripheral structure constitutes a bearing surface through which the vacuum cleaner can rest on the floor.

The inflatable peripheral structure preferably includes a first free passage in line with the air inlet to enable connection of an air suction tube to the air inlet, and the first free passage is surrounded by a protruding inflatable lip relative to which the air inlet is set back. This assures effective protection, by preventing the internal structure part near the air inlet from coming into contact with surrounding objects such as furniture.

In this case, the inflatable peripheral structure possibly includes a second free passage through which passes the cord for connecting the vacuum cleaner to the external electrical power distribution network. The second free passage is also surrounded by a protruding inflatable lip, for the same reasons as the first free passage.

In one advantageous embodiment, the inflatable peripheral structure is in one piece delimited by a continuous outside peripheral wall.

Alternatively, the inflatable peripheral structure includes a first inflatable peripheral member and a second inflatable peripheral member separated from each other by an annular groove through which the suction tube and/or the cord for connecting the vacuum cleaner to the external electrical power distribution network can be passed.

In this case, the two inflatable peripheral members are preferably rotatable about a rotation axis generally perpendicular to the axis of the air inlet. The vacuum cleaner can then roll on the floor on the inflatable peripheral members, which are retained on the internal structure by axial guide means and can turn about a cylindrical surface of the internal structure with a layer of air between them blown by the vacuum cleaner.

Another alternative is for the inflatable peripheral structure to comprise a plurality of tubular inflatable peripheral members arranged at the periphery of the internal structure of the vacuum cleaner.

BRIEF DESCRIPTION OF THE DRAWINGS

Other objects, features and advantages of the present invention will emerge from the following description of specific embodiments, given with reference to the accompanying drawings, in which.

DESCRIPTION OF THE PREFERRED EMBODIMENTS

Figure 1:
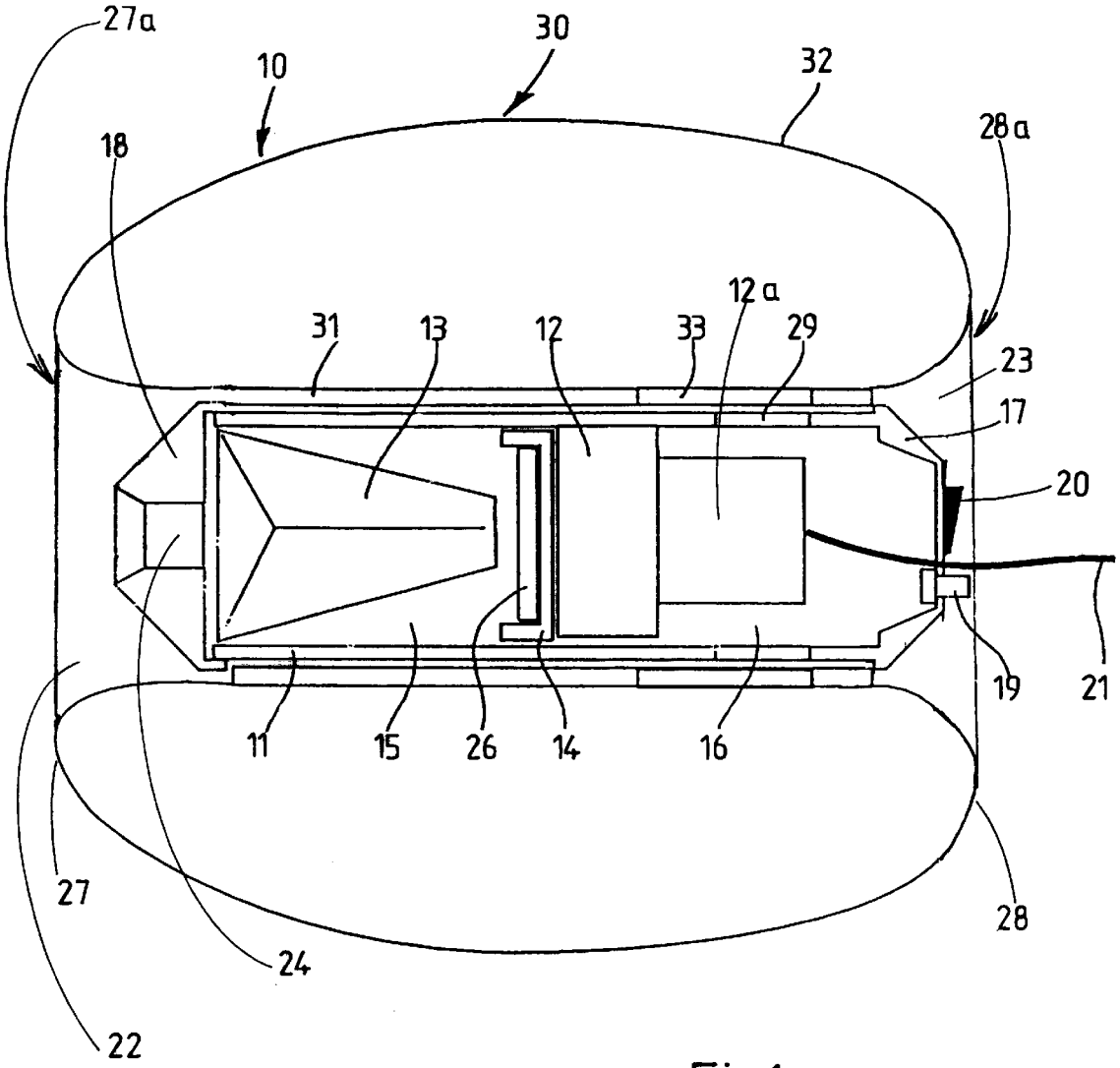
FIG. 1 is a side view in longitudinal section of a first embodiment of a vacuum cleaner in accordance with the present invention.
Figure 2:
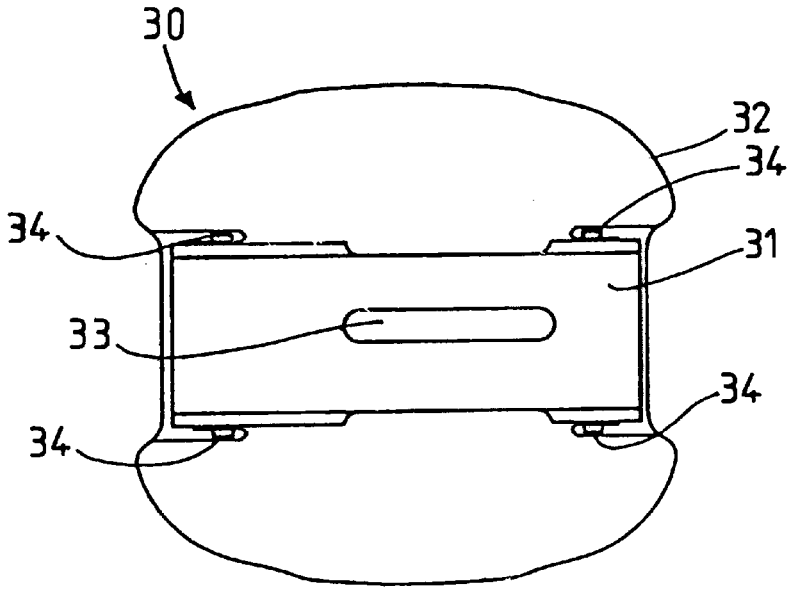
FIG. 2 is a side view in longitudinal section of the inflatable peripheral structure of the embodiment from FIG. 1.
Figure 3:
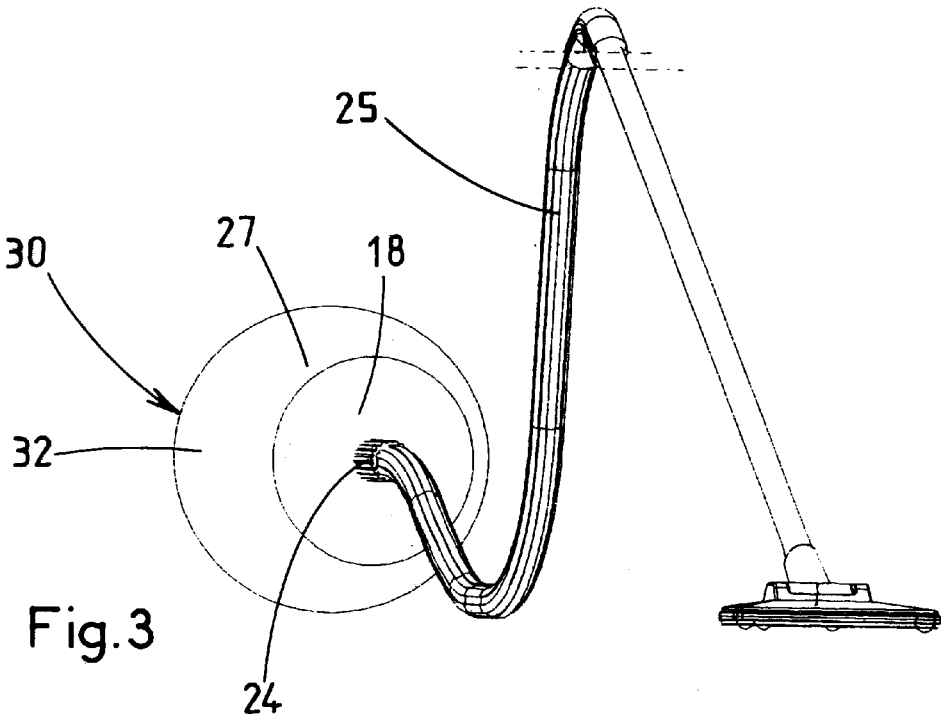
FIG. 3 is a perspective view of the FIG. 1 embodiment of a vacuum cleaner.

In the embodiment shown in FIGS. 1 to 3, the vacuum cleaner 10 essentially comprises an internal structure contained within a rigid hollow tubular casing 11 and including a suction turbine 12 driven by a motor 12*a*. The motor 12*a* is held in the casing 11 by means of a support 14 which defines an upstream chamber 15 and a downstream chamber 16. The upstream chamber 15 is shaped to contain a dust bag 13, and has an air inlet 24. The support 14 is shaped to allow air to pass from the upstream chamber 15 to the downstream chamber 16 through one or more filters 26 that prevent undesirable particles entering the motor 12*a*.

In this embodiment, the motor 12*a* and the suction turbine 12 are in the downstream chamber 16.

An upstream cover 18 closes the upstream end of the upstream chamber 15, and incorporates the air inlet 24.

A downstream cover 17 closes the downstream end of the downstream chamber 16.

The downstream cover 17 can include a safety valve 19 adapted to allow air to pass through it as soon as the pressure in the downstream chamber 16 rises above a predetermined threshold value.

In the embodiment shown, the downstream cover 17 also incorporates an electric switch 20 for making or breaking the electrical power supply connection to the motor 12*a*. The electrical power supply to the electric motor 12*a* is assured by a cord 21 connecting to the external electrical power distribution network. The cord 21 can be associated with a winder accommodated in the casing 11, not shown in the figures, to enable selective retraction of the cord 21 when the vacuum cleaner is not in use, in a fashion that is known to the skilled person.

The downstream chamber 16 communicates with the outside atmosphere via an air outlet, for example via the opening 29 formed in the casing 11.

The vacuum cleaner in accordance with the invention further includes an inflatable peripheral structure 30 supplied with air via the air outlet 29.

In the embodiment shown in FIGS. 1 to 3, the inflatable peripheral structure 30 comprises a single structural element, and is delimited by a tubular inside wall 31 fitted around the casing 11, and by a flexible outside peripheral wall 32. The walls 31 and 32 define an inflatable annular enclosure surrounding an interior space open at two opposite ends 22 and 23, each of which constitutes a free passage.

The first end 22 constitutes a first free passage in line with the air inlet 24 and enabling an air suction tube 25 to be connected to the air inlet 24. This first free passage 22 is surrounded by a portion of the outside peripheral wall 32 constituting a protruding inflatable lip 27 relative to which the air inlet 24 is set back.

The second end 23 constitutes a second free passage through which passes the cord 21 for connecting the vacuum cleaner to the external electrical power distribution network. In the same fashion, the second free passage 23 is surrounded by a portion of the outside peripheral wall 32 constituting a protruding inflatable lip 28.

As can be seen in FIG. 1, the inflatable peripheral structure 30 is delimited by a continuous flexible outside peripheral wall 32 the envelope of which entirely surrounds all of the internal structure of the vacuum cleaner including the air suction means 12 and 12*a*, the air filtering means 13 and 26, together with the air exhaust means 29.

In this description and in the accompanying claims, the term "envelope" denotes the minimum volume convex outside surface containing the inflatable peripheral structure. In the case of FIG. 1, the envelope is formed by the outside surface of the outside peripheral wall 32, joined to end planes 27*a* and 28*a* tangential to the respective edges of the lips 27 and 28. This envelope entirely surrounds all of the internal structure of the vacuum cleaner and in particular the motor 12*a*, the turbine 12, the rigid casing 11, the covers 17 and 18.

Because the inflatable structure 30 entirely surrounds the internal structure of the vacuum cleaner, it is through a portion of the inflatable structure that the vacuum cleaner rests on the floor. It can slide on the floor or roll through being in contact with the floor via the flexible outside peripheral wall 32 of the inflatable peripheral structure 30.

The upstream cover 18 can advantageously be fixed to the casing 11 by screws or by a bayonet type fixing, or with flanges. It therefore provides access to the upstream chamber 15 for fitting or removing the bag 13 or the filters 26.

As can be seen better in FIG. 3, the air inlet 24 in the upstream cover 18 is shaped to enable a suction tube 25 such as a flexible tube to be fitted to it.

As can be seen in more detail in FIG. 2, the peripheral structure 30 delimited by the outside peripheral wall 32 comprises a tubular inside wall 31 shaped to fit onto the tubular outside wall of the casing 11.

The tubular inside wall 31 includes one or more openings 33 coinciding with the openings 29 of the downstream chamber 16 of the casing 11 when the inflatable peripheral structure 30 is fitted around the casing 11. For example, the openings 33 are in the form of four elongate slots evenly distributed around the tubular inside wall 31 of the inflatable peripheral structure 30. The openings 29 of the downstream chamber 16 are in the form of a plurality of rows of holes disposed all around the periphery of the casing 11, for example, so that at least one of the slots 33 in the inflatable peripheral structure 30 coincides with one of the openings 29 in the casing 11 regardless of the angular position of the inflatable peripheral structure 30 around the casing 11.

The outside peripheral wall 32 can be made from a synthetic material or from a woven material allowing partial passage of air. The edges of the outside peripheral wall 32 can be fixed to the ends of the tubular inside wall 31 by flanges 34 as shown in FIG. 2, or by any other appropriate fixing means. The inflatable peripheral structure 30 is entirely closed so that air entering it can escape only via the openings 33 or via the material that forms the outside peripheral wall 32. Also, the outside peripheral wall 32 is flexible so that it can inflate or deflate depending on the air that it contains.

When the outside peripheral wall 32 is made from an airtight material, a safety valve 19 is advantageously provided to allow some of the air inside the inflatable peripheral structure 30 to escape as soon as the pressure inside the structure exceeds a predetermined threshold value.

An inflatable peripheral structure 30 made from a flexible and expandable material contained in a flexible but non-expandable net which limits the capacity for deformation under pressure can be designed. The net can be made of a wear-resistant material which improves the protection of the inflatable peripheral structure against wear caused by rubbing on the floor.

When the motor 12*a* is energised, it produces suction that increases the air pressure inside the downstream chamber 16. The air then enters the inflatable peripheral structure 30 via the openings 29 and the slots 33, and it inflates the outside peripheral structure 30. The volume of the outside peripheral structure 30 increases because of this pressure until the structure is entirely inflated. The air then escapes to the outside atmosphere either through the outside peripheral wall 32 or through appropriate openings.

When the peripheral structure 30 is inflated, the vacuum cleaner slides or rolls easily on the floor and can be moved effortlessly in any direction. The inflatable peripheral structure 30 advantageously replaces the wheels of a conventional vacuum cleaner, can easily pass over the thresholds of doorways, and cannot overturn or become trapped in the fringes of carpets or entrain refuse.

When switched off, the volume of the vacuum cleaner in accordance with the invention is small. In operation, the inflatable peripheral structure 30 can be relatively thick, which assures excellent protection against impact.

It will be understood that various shapes of inflatable peripheral structure 30 can be used with the same internal vacuum cleaner structure to modify the aesthetics of the vacuum cleaner at very low cost.

Figure 4:
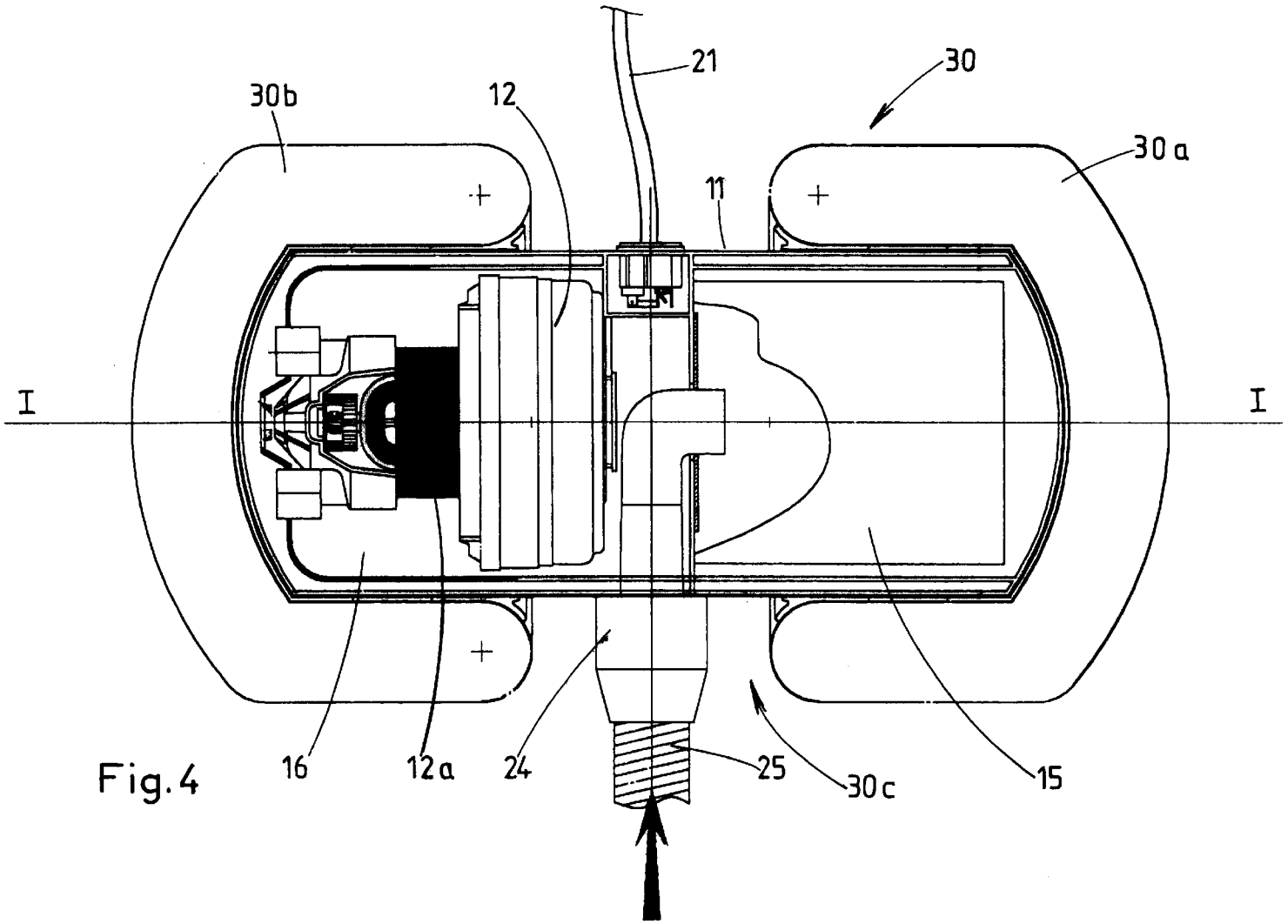
FIG. 4 is a view in longitudinal section of a second embodiment of a vacuum cleaner in accordance with the present invention.

In the embodiment shown in FIG. 4, the essential elements of the vacuum cleaner in accordance with the present invention are identified by the same reference numbers: the motor 12*a* driving the turbine 12, an upstream chamber 15, a downstream chamber 16, the air inlet 24, an inflatable peripheral structure 30.

In this second embodiment, the inflatable peripheral structure 30 comprises a first inflatable peripheral member 30*a* and a second inflatable peripheral member 30*b* which are separated from each other by an annular groove 30*c* through which can pass the suction tube 25 and/or the cord 21 for connecting the vacuum cleaner to the external electrical power distribution network.

Each of the inflatable peripheral members 30*a* and 30*b* has a continuous enveloping shape such as a blind cylindrical shape, as shown in the figure.

The two inflatable peripheral members 30*a* and 30*b* are rotatable about a rotation axis I—I generally perpendicular to the axis of the air inlet 24, the air inlet 24 being located inside the peripheral groove 30*c*.

As in the embodiment shown in FIGS. 1 to 3, the internal structure of the vacuum cleaner is contained in a tubular casing 11 oriented along the rotation axis I—I.

Each of the inflatable peripheral members 30*a* and 30*b* is retained to the internal structure by axial guide means, and turns about an end portion of the cylindrical casing 11, said end portion being then a circular cylinder.

A layer of air can advantageously be blown by the vacuum cleaner between the inflatable peripheral member 30*a* and 30*b* and the outside surface of the casing 11.

Figure 6:
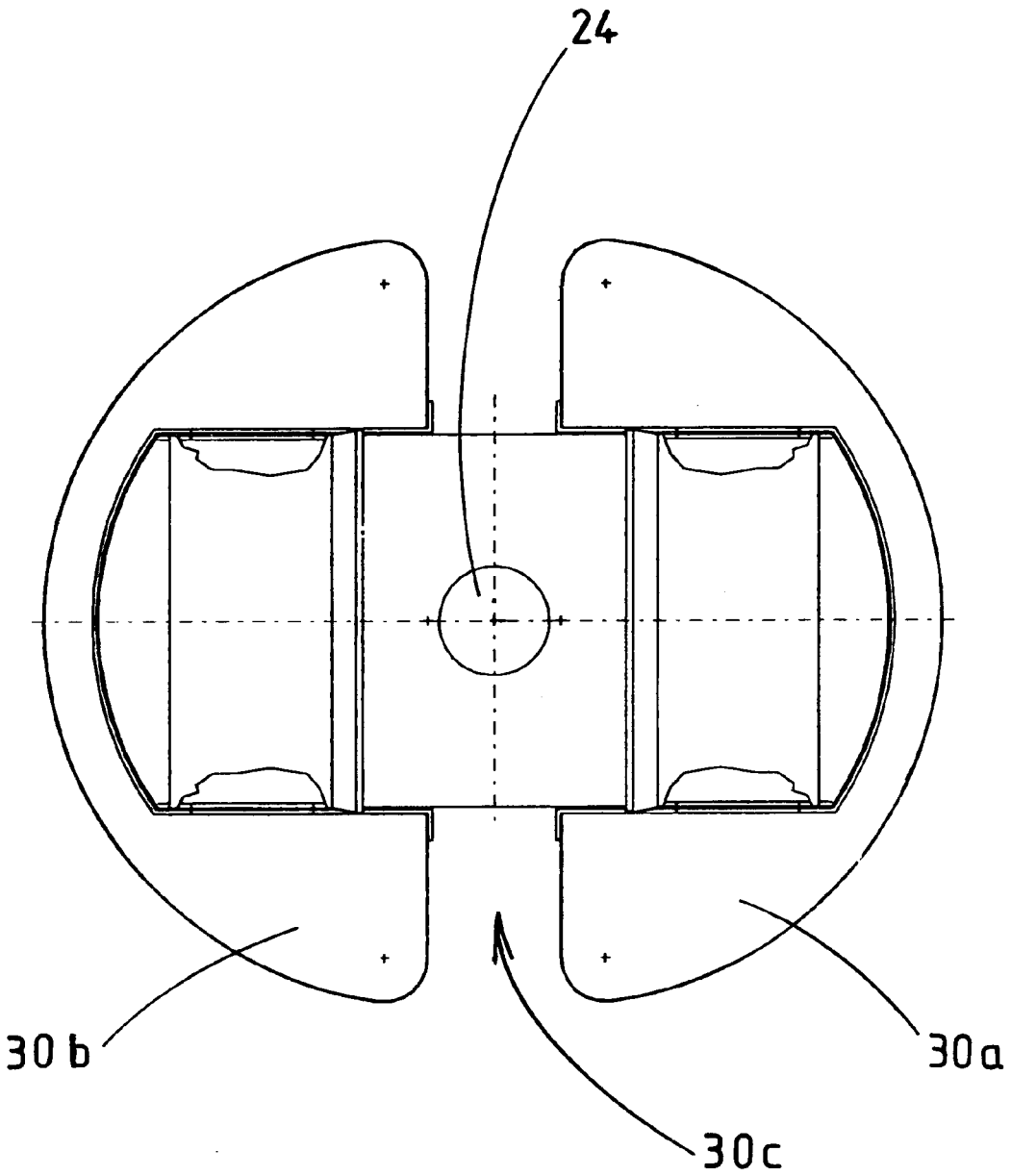
FIG. 6 is a view in longitudinal section of a fourth embodiment of a vacuum cleaner in accordance with the invention.

The variant shown in FIG. 6 adopts the same structure as the FIG. 4 embodiment, with two inflatable peripheral members 30*a* and 30*b*. The difference lies in the outside shape of the inflatable peripheral members 30*a* and 30*b*, which are spherical domes.

Figure 5:
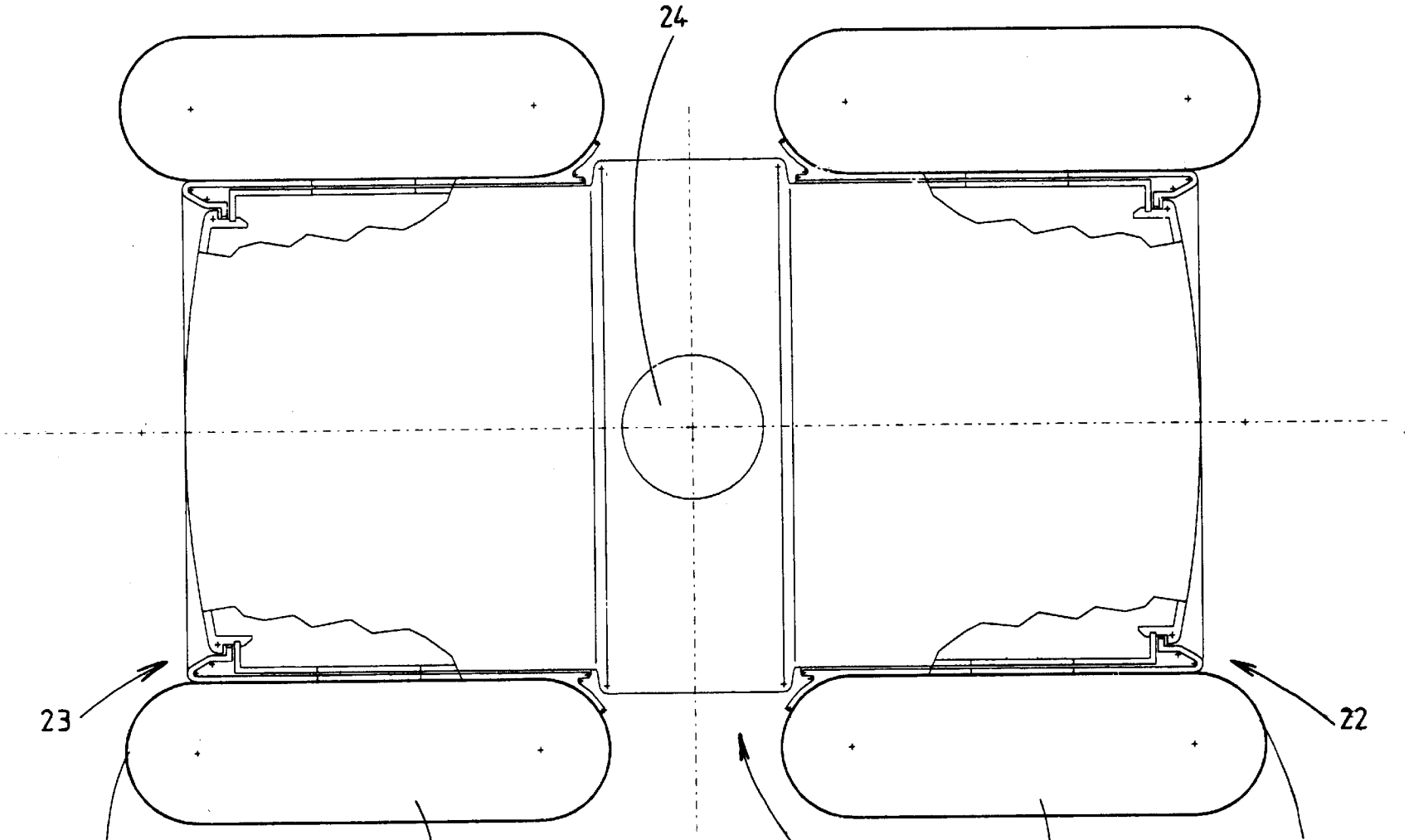
FIG. 5 is a diagrammatic view in longitudinal section of a third embodiment of a vacuum cleaner in accordance with the invention.

In the FIG. 5 embodiment, there are also two inflatable peripheral members 30*a* and 30*b* separated by an annular groove 30*c* through which a suction tube connected to the air inlet 24 can pass. Each of the inflatable peripheral members 30*a* and 30*b* is annular in shape, with an end passage 22 or 23 surrounded by a protruding inflatable lip 27 or 28, as in the FIG. 1 embodiment.

Figure 8:
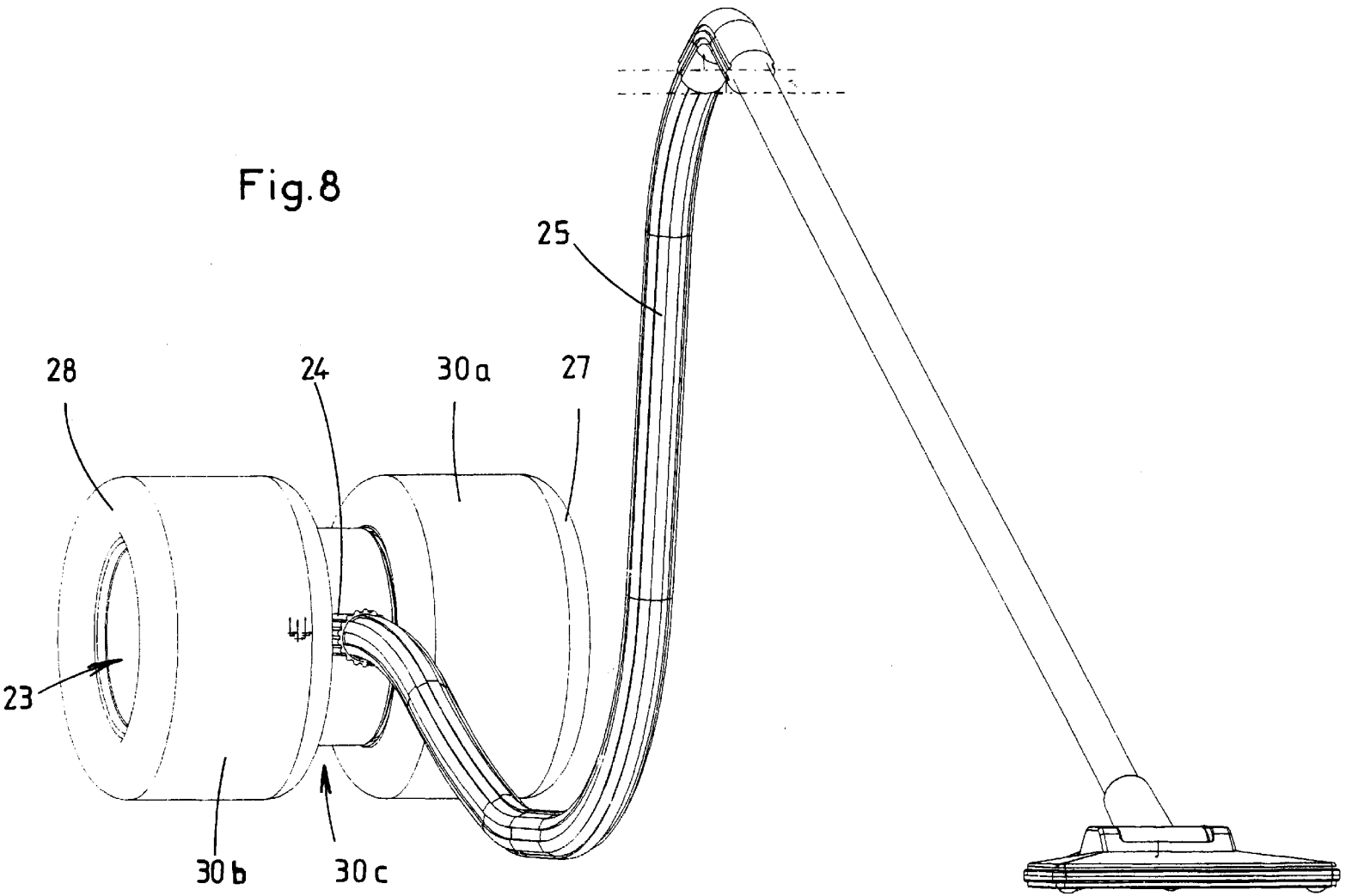
FIG. 8 is a perspective view of the FIG. 5 embodiment of the vacuum cleaner in accordance with the invention.

FIG. 8 is a perspective view of this embodiment of a vacuum cleaner.

In the embodiments with two inflatable peripheral members 30*a* and 30*b*, the inflatable peripheral members 30*a* and 30*b* can advantageously be rotatable about the internal structure of the vacuum cleaner.

Figure 7:
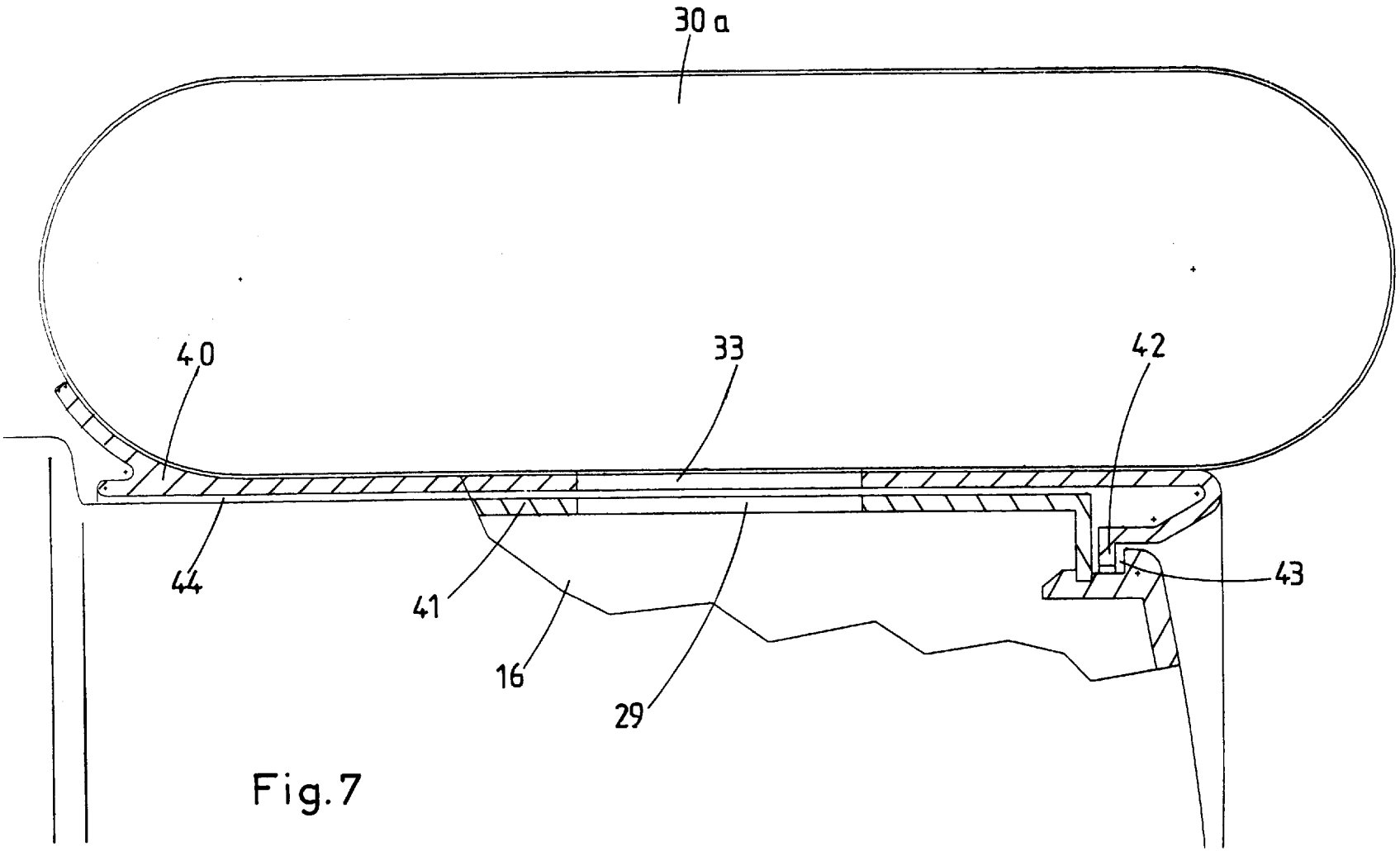
FIG. 7 shows, to a larger scale, the connection between a rotatable inflatable peripheral structural member and the internal structure of the FIG. 5 embodiment of the vacuum cleaner.

FIG. 7 shows one way of rotatably mounting inflatable peripheral members like the member 30*a*: the inflatable flexible envelope, constituting the essential part of the inflatable peripheral member 30*a*, is fastened to a rigid tubular base 40 that rotates about a cylindrical element 41 of the internal structure of the vacuum cleaner. The circular cylindrical element 41 can be either an end portion of a casing 11, as previously described, or a separate member. One end of the base 40 is bent to form a guide flange 42 engaged in an annular groove 43 in the internal structure of the vacuum cleaner. A space 44 is left between the cylindrical member 41 and the tubular base 40, and between the walls of the groove 43 and the guide flange 42. In operation, the air leaving the downstream chamber 16 of the vacuum cleaner via the opening 29 enters the inflatable peripheral member 30*a* via the opening 33 to inflate the inflatable peripheral member 30*a*. When that member is inflated, the air escapes via the space 44, and constitutes an air cushion encouraging friction-free rotation of the inflatable peripheral member 30*a* around the cylindrical element 41 of the internal structure of the vacuum cleaner. The guide flange 42 and the groove 43 constitute axial guide means that retain the corresponding inflatable peripheral member 30*a* onto the internal structure of the vacuum cleaner. The base 40 of the inflatable peripheral member 30*a* turns around the cylindrical element 41 of the internal structure with a layer of air between them blown in by the vacuum cleaner and filling the space 44.

Rotary inflatable peripheral members 30*a* and 30*b* constitute soft bearing means which, compared to conventional hard bearing means, improve rolling, prevent bearing noises, and facilitate passing over obstacles such as thresholds of doorways or carpet edges. Rotary inflatable peripheral members of this kind can be used independently of the presence or the absence of the other features described or claimed. For example, rotary peripheral members of smaller cross-section can advantageously be provided, no longer providing complete protection against impacts with the internal structure of the vacuum cleaner, but still guaranteeing the advantages of the soft bearing mentioned above.

Figure 9:
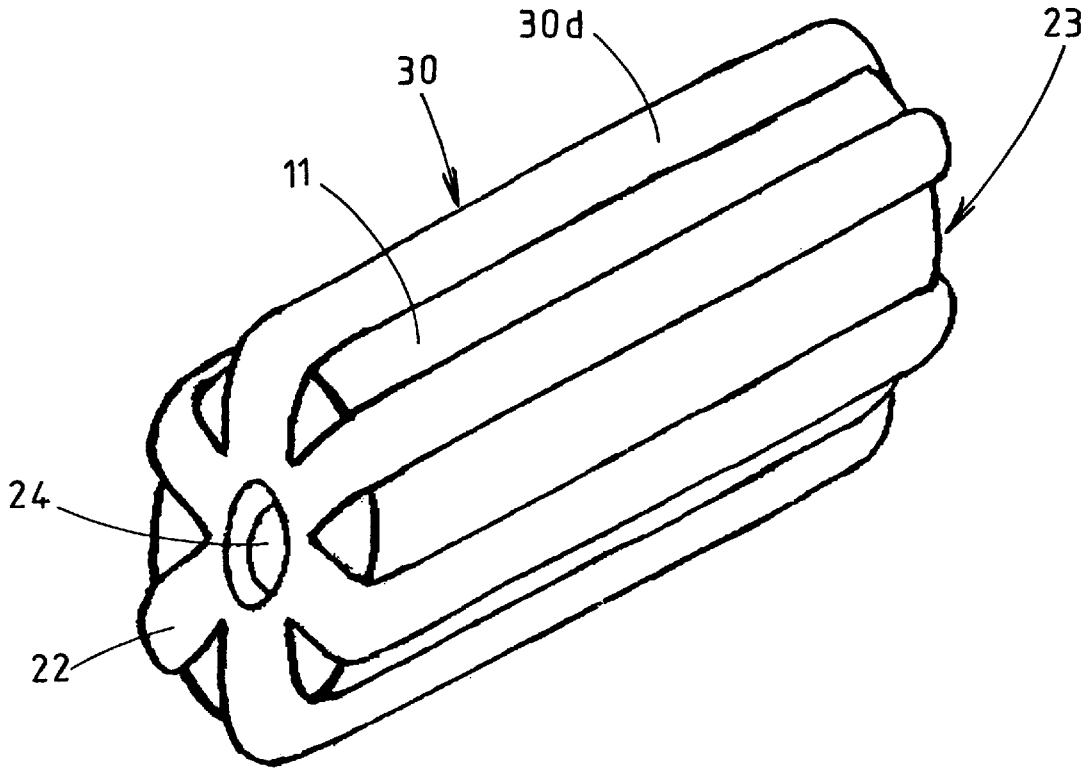
FIG. 9 shows a fifth embodiment of a vacuum cleaner in accordance with the present invention.

FIG. 9 shows another embodiment of the invention in which the inflatable peripheral structure 30 is formed of a plurality of tubular inflatable peripheral members 30*d*, distributed at the periphery of the internal structure of the vacuum cleaner such as a rigid cylindrical casing 11, the tubular peripheral members 30*d* being joined together at two ends 22 and 23 where the air outlet 24 and the cord outlet are situated.

Clearly the inflatable peripheral structure 30 can have any of a very wide choice of other external shapes providing an attractive aesthetic appearance. It is thus possible to give the vacuum cleaner a characteristic three-dimensional shape for advertising or other purposes.

In all cases, in accordance with the invention, no rigid component projects from the convex envelope within which the flexible peripheral walls 32 of the inflatable peripheral structure 30 are inscribed.

The present invention is not limited to the embodiments explicitly described but encompasses variants and generalisations thereof included within the scope of the following claims.

What is claimed is:

1. A vacuum cleaner for household refuse comprising an internal structure having means for aspirating air laden with household refuse via an air inlet, means for filtering the aspirated air and retaining the household refuse that it contains, means for evacuating the filtered air via at least one air outlet, and an inflatable peripheral structure supplied with air via said air outlet, wherein the inflatable peripheral structure is delimited by at least one flexible outside peripheral wall the envelope of which entirely surrounds all of the internal structure of the vacuum cleaner comprising the air suction, filter and exhaust means, wherein the inflatable peripheral structure includes a first free passage in line with the air inlet to enable connection of an air suction tube to the air inlet, the first free passage being surrounded by a protruding inflatable lip relative to which the air inlet is set back.

2. A vacuum cleaner according to claim 1, wherein a portion of the inflatable peripheral structure constitutes a bearing surface through which the vacuum cleaner can rest on the floor.

3. A vacuum cleaner according to claim 1, wherein the inflatable peripheral structure includes a second free passage through which passes a cord for connecting the vacuum cleaner to the external electrical power distribution network, the second free passage being surrounded by a protruding inflatable lip.

4. A vacuum cleaner according to claim 1, wherein the inflatable peripheral structure is in one piece delimited by a continuous outside peripheral wall.

5. A vacuum cleaner for household refuse comprising an internal structure having means for aspirating air laden with household refuse via an air inlet, means for filtering the aspirated air and retaining the household refuse that it contains, means for evacuating the filtered air via at least one air outlet, and an inflatable peripheral structure supplied with air via said air outlet, wherein the inflatable peripheral structure is delimited by at least one flexible outside peripheral wall the envelope of which entirely surrounds all of the internal structure of the vacuum cleaner comprising the air suction, filter and exhaust means, wherein the inflatable peripheral structure includes a first inflatable peripheral member and a second inflatable peripheral member separated from each other by an annular groove through which a suction tube and/or a cord for connecting the vacuum cleaner to the external electrical power distribution network can be passed.

6. A vacuum cleaner according to claim 5, wherein each of the inflatable peripheral members is of annular shape with an end passage surrounded by a protruding inflatable lip.

7. A vacuum cleaner according to claim 5, wherein each of the inflatable peripheral members is of continuous enveloping shape.

8. A vacuum cleaner according to claim 7, wherein each of the inflatable peripheral members is of a blind cylindrical shape.

9. A vacuum cleaner according to claim 7, wherein each of the inflatable peripheral members is of a spherical dome shape.

10. A vacuum cleaner according to claim 5, wherein the two inflatable peripheral members are rotatable about a rotation axis generally perpendicular to the axis of the air inlet.

11. A vacuum cleaner according to claim 10, wherein the inflatable peripheral members are retained on the internal structure by axial guide means and turn about a cylindrical element of the internal structure with a layer of air between them blown by the vacuum cleaner.

12. A vacuum cleaner for household refuse comprising an internal structure having means for aspirating air laden with household refuse via an air inlet, means for filtering the aspirated air and retaining the household refuse that it contains, means for evacuating the filtered air via at least one air outlet, and an inflatable peripheral structure supplied with air via said air outlet, wherein the inflatable peripheral structure is delimited by at least one flexible outside peripheral wall the envelope of which entirely surrounds all of the internal structure of the vacuum cleaner comprising the air suction, filter and exhaust means, wherein the inflatable peripheral structure includes a plurality of tubular inflatable peripheral members distributed at the periphery of the internal structure.

* * * * *

UNITED STATES PATENT AND TRADEMARK OFFICE

CERTIFICATE OF CORRECTION

PATENT NO : 6,141,822

DATED : November 7, 2000

INVENTOR(S) : Agneta Riviera-Boklund et al

It is certified that error appears in the above-identified patent and that said Letters Patent is hereby corrected as shown below:

On the cover page, under Foreign Application Priority Data, please delete "2356196" and insert instead --2356/96 --.

On the cover page, under References Cited, please add the following references:

U.S. Patent No. 4,533,370 (Ikezaki et al) 8/6/85

U.S. Patent No. 4,947,506 (Foster) 8/14/90

German Patent No,.2213716 (Thies et al) 9/27/73

German Patent No. 3042894 (Lottes) 5/27/82

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*